US006361229B1

(12) United States Patent
Shinga

(10) Patent No.: US 6,361,229 B1
(45) Date of Patent: Mar. 26, 2002

(54) PAPER ROLL SUPPORTING DEVICE FOR AN IMAGE FORMING APPARATUS

(75) Inventor: Takahiro Shinga, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/662,360

(22) Filed: Sep. 15, 2000

(30) Foreign Application Priority Data

Sep. 16, 1999 (JP) ..... 11-261849

(51) Int. Cl.[7] ..... B60R 5/04

(52) U.S. Cl. ..... 400/613; 160/323.1; 242/597.2; 242/597.6; 242/598; 242/599.4

(58) Field of Search ..... 400/208, 206.4, 400/207, 236, 242, 246, 613, 611, 612; 242/597.6, 597.5, 598, 599.4, 600, 599; 160/323.1, 324, 325, 326

(56) References Cited

U.S. PATENT DOCUMENTS 2,538,827 A * 1/1951 Burns ..... 160/323

5,934,354 A * 8/1999 Price et al. ..... 160/370.22

* cited by examiner

*Primary Examiner*—John S. Hilten
*Assistant Examiner*—Kevin D. Williams
(74) *Attorney, Agent, or Firm*—Oblon, Spivak, McClelland, Maier & Neustadt, P.C.

(57) ABSTRACT

A paper roll supporting device for an image forming apparatus includes a pair of flange members to be inserted into opposite ends of a paper roll. Each flange member includes a flange body made up of a flange portion and a cylindrical support portion that is to be inserted into a tubular core included in the paper roll. A claw member has a plurality of claws capable of protruding from the outer circumference of the support portion. A biasing member exerts a pressure on the claw member. Pressing means is slidable in a direction in which the biasing member is compressible. The pressing means receives one end of the biasing member and contacts the inner circumference of the support portion. A lock/release lever is capable of being brought down for causing the pressing means to slide. The claw member causes its pawls to flare in the radial direction when pressed in the axial direction of the support portion. The device with this configuration can be easily locked to the paper roll.

24 Claims, 8 Drawing Sheets

PAPER ROLL SUPPORTING DEVICE FOR AN IMAGE FORMING APPARATUS

BACKGROUND OF THE INVENTION

The present invention relates to a printer, copier, facsimile apparatus or similar image forming apparatus including a paper feeding mechanism, and more particularly to a paper roll supporting device for supporting a paper roll applicable to the image forming apparatus.

It is a common practice with an image forming apparatus to set a paper roll by use of a spool type of member. This kind of scheme allows a paper roll to be supported over its entire width and allows a spool to be directly positioned by opposite side walls of the apparatus. The paper roll therefore shakes little and is easy to transport. However, in a large-scale machine capable of dealing with paper of up to size AO, the spool is as long as 1 m and makes the attachment and detachment of a paper roll difficult. For this reason, the spool scheme is not feasible for a large-scale machine.

On the other hand, Japanese Utility Model Laid-Open Publication No. 64-43048 and Japanese Utility Model Publication No. 7-48598 each propose to fit flanges in opposite ends of a paper roll and position the flanges on rollers. Specifically, Laid-Open Publication No. 64-43048 discloses a paper roll supporting device including a support wheel, a nut, and a screw. The support wheel includes a cylindrical portion whose outside diameter is slightly smaller than the inside diameter of an axial center bore formed in a paper roll. A plurality of axial slits are formed in the circumferential wall of the cylindrical portion. A flared flange extends out from one end of the cylindrical portion. The nut has a conical pressing surface contacting the inner periphery of the open end of the cylindrical portion. The screw connects the nut to the support wheel. The screw presses the inner wall of the tubular core of the paper roll via the flange, exerting a great retaining force. This kind of device, however, forces the operator to drive the screw and perform other troublesome operations at the time of setting.

On the other hand, Publication No. 7-48598 teaches a paper roller supporting device including a body member to be inserted into the core of a paper roll an end support member that supports the paper roll. An auxiliary member is inserted in a through hole formed in the body member. A plurality of arm members protrude from the body member in the direction in which the end support member is to be inserted into the core. A lug protrudes from each arm member toward the wall of the through hole. The auxiliary member includes a tubular portion to be received in the through hole of the body member. Lug members protrude from the outer circumference of the tubular member, and each is formed with a recess at its top. When the auxiliary member is inserted into the body member and rotated bout is own axis, the lugs of the arm members mate with the recesses of the lug members while the arm members flare and press the inner periphery of the core. This kind of configuration effectively presses the inner periphery of the core by using an elastic force available with resin. However, because the cylindrical member is rotated to elastically deform the resin members with the lugs, the body member itself rotates together with the cylindrical member unless the operator holds the flange.

SUMMARY OF THE INVENTION

It is therefore an object of the present invention to provide a paper roll supporting device for an image forming apparatus including improved flanges for promoting easy setting operation.

A paper roll supporting device for an image forming apparatus of the present invention includes a pair of flange members to be inserted into opposite ends of a paper roll. Each flange member includes a flange body made up of a flange portion and a cylindrical support portion that is to be inserted into a tubular core included in the paper roll. A claw member has a plurality of claws capable of protruding from the outer circumference of the support portion. A biasing member exerts a pressure on the claw member. Pressing means is slidable in a direction in which the biasing member is compressible. The pressing means receives one end of the biasing member and contacts the inner circumference of the support portion. A lock/release lever is capable of being brought down for causing the pressing means to slide. The claw member causes its pawls to flare in the radial direction when pressed in the axial direction of the support portion.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
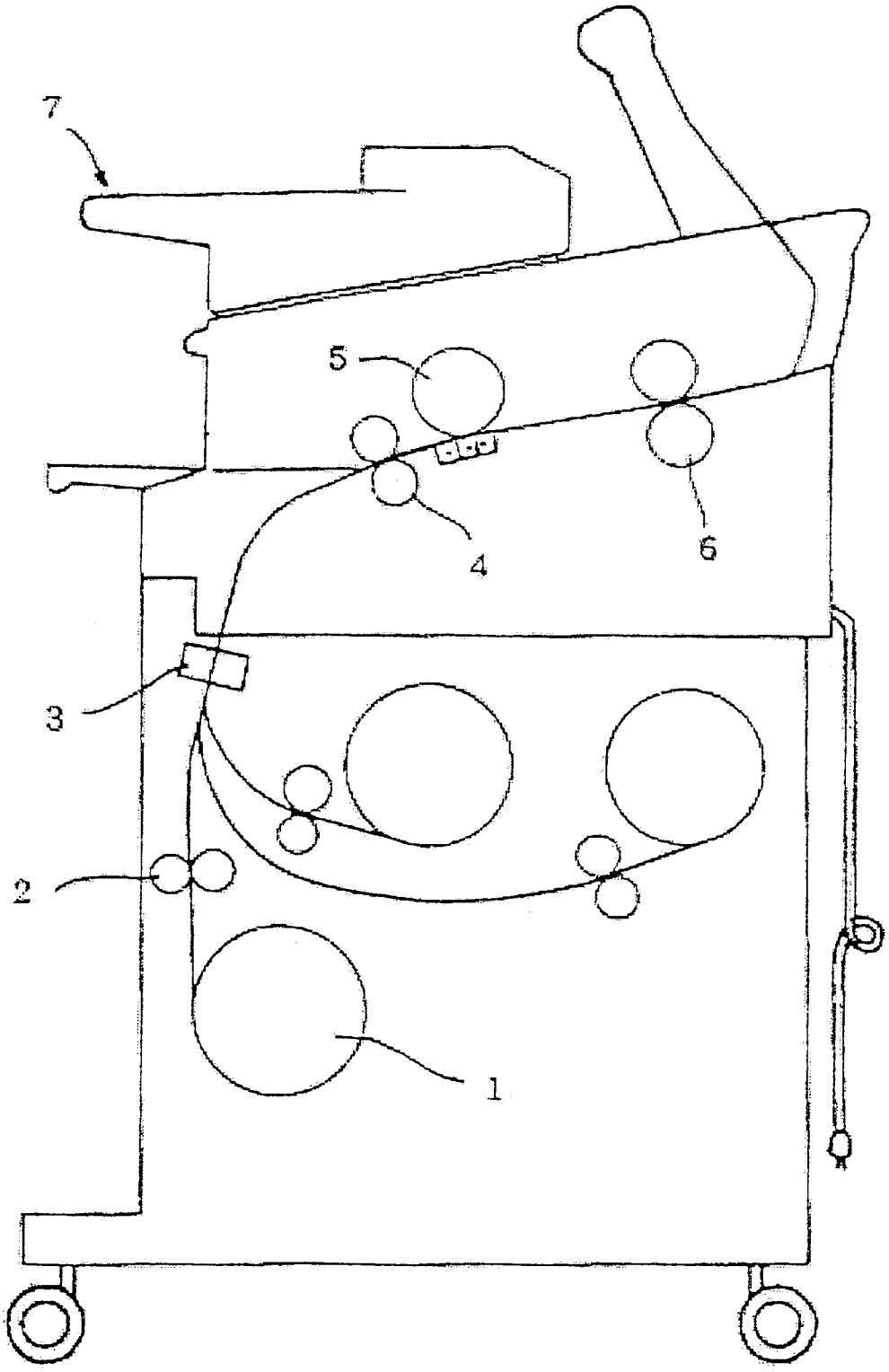
FIG. 1 is a view showing the general construction of an image forming apparatus including a paper roll supporting device embodying the present invention.

Referring to FIG. 1 of the drawings, an image forming apparatus including a paper roll supporting device embodying the present invention is shown and implemented as a copier by way of example. The copier includes a paper tray, not shown, which is movable into and out of a copier body by hand. As shown, a plurality of paper rolls 1 are set from the above or from the front (left-hand side in FIG. 1) after the paper tray has been pulled out of the copier body. Feed roller pairs 2 each convey paper paid out from a particular paper roll 1 toward an image forming section. Paper conveyance paths extending from the roller pairs 2 join each other at a position short of a cutter 3. The cutter 3 cuts each paper at a preselected length necessary for image formation. As a result, a sheet cut off by the cutter 3 is delivered toward the image forming section.

A registration roller pair 4 drives the sheet at a preselected timing synchronous to an image forming timing. An image transfer section 5 includes a photoconductive element and transfers a toner image from the photoconductive element to the sheet. A fixing section 6 fixes the toner image transferred to the sheet. The sheet coming out of the fixing section 6 is driven out of the copier body. On the other hand, a scanning section 7 conveys a document and reads image information out of the document. The photoconductive element is exposed imagewise in accordance with the image data output from the scanning section 7.

Figure 2:
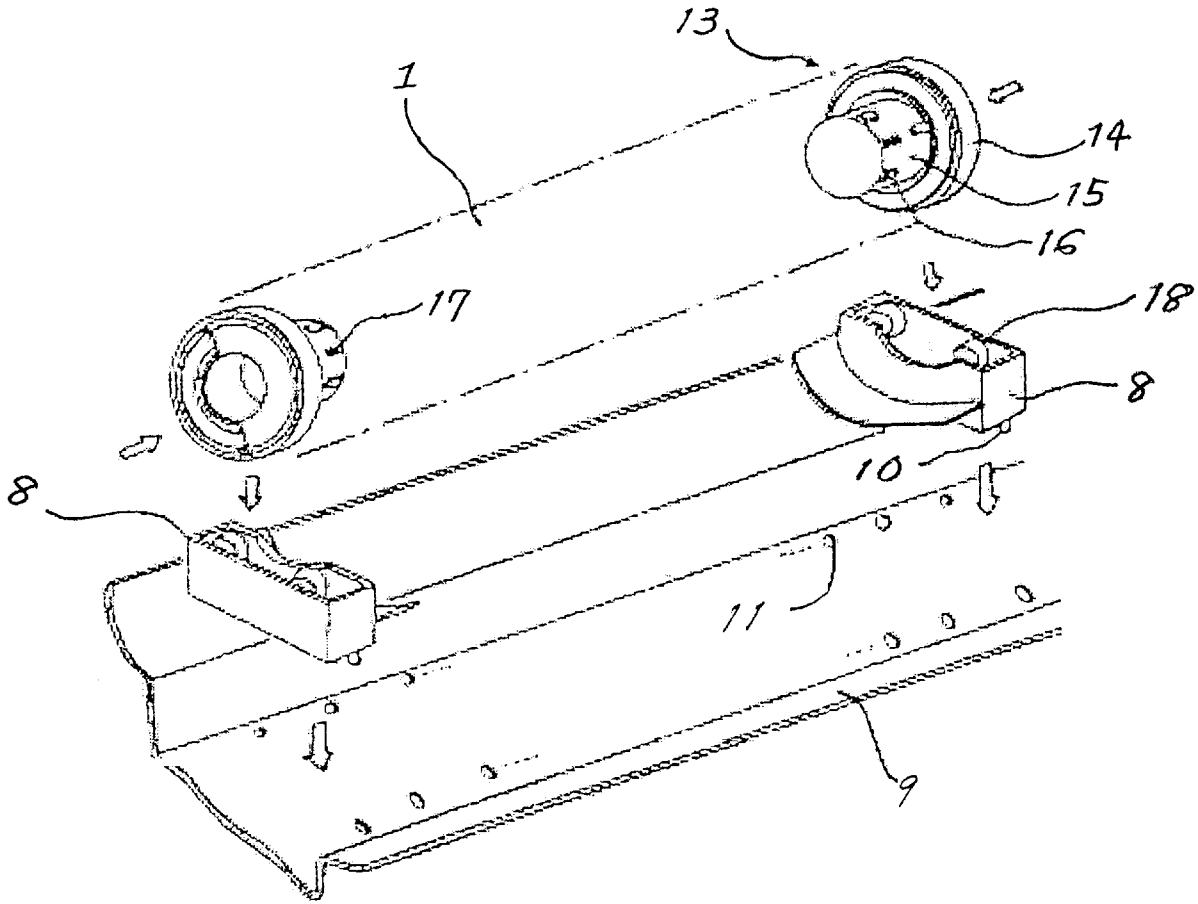
FIG. 2 is an isometric view showing the paper roll supporting device.
Figure 3:
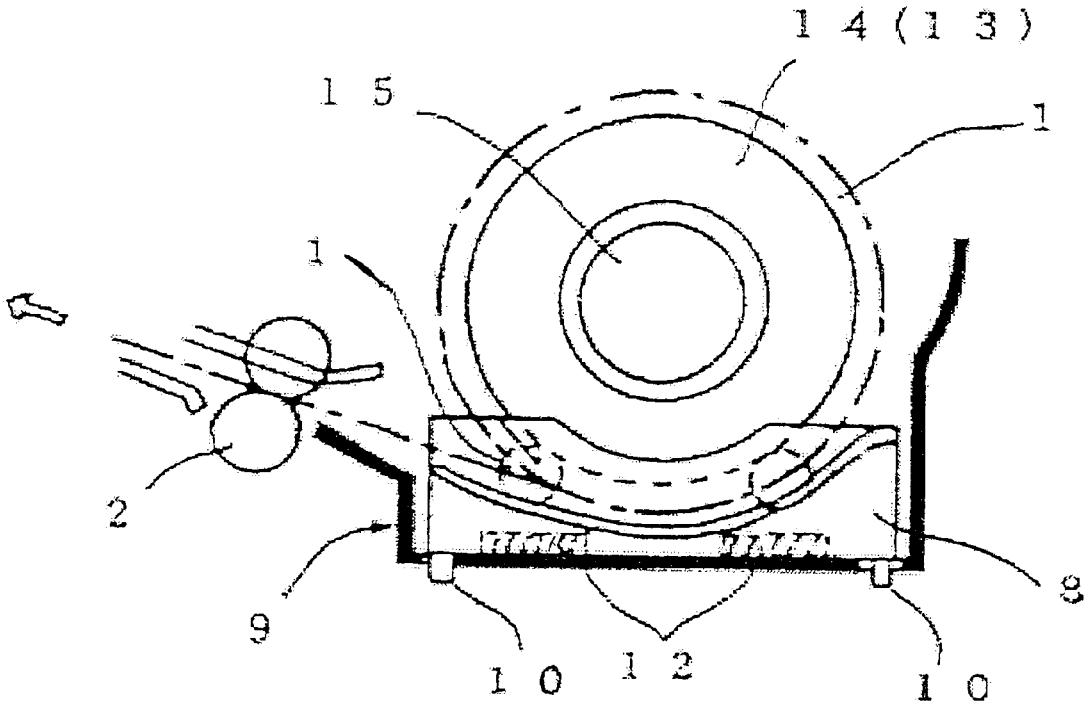
FIG. 3 is a side elevation showing a paper roll set by the paper roll supporting device.

FIG. 2 is an exploded view showing how one of the paper rolls 1 is loaded on a preselected roll setting portion included in the copier body. FIG. 3 is a side elevation showing the paper roll 1 set on the paper roll setting portion. As shown, the roll setting portion includes a pair of supports 8 and a bottom plate 9 on which the supports 8 are positioned. Bosses 10 protrude downward from the bottom of each support 8. A plurality of holes 11 are formed in the bottom plate 9 and capable of receiving the bosses 10. The plurality of holes 11 allow the roll supporting portion to adapt to a plurality of standard roll sizes. The base 9 is formed of metal or similar conductive material for attracting magnets 12 (see FIG. 3) affixed to the bottoms of the supports 8. In this configuration, when the bosses 10 are inserted into the holes 11, the supports 8 are magnetically locked to the bottom plate 9.

A pair of flange members 13 are inserted into opposite ends of the tubular core of the paper roll 1. The flange members 13 each are made up of a flange portion 14 and a cylindrical support portion 15 smaller in diameter than the flange portion 14 and capable of being inserted into the core of the paper roll 1. Three ribs 16 protrude from the outer circumference of one end of the support portion 15 remote from the flange portion 14 and are positioned at equally spaced locations along the circumference. Likewise, three ribs 3 protrude from the outer circumference of the other end of the support portion 15 and are positioned at equally spaced locations along the circumference. The ribs 3 in combination define an outside diameter substantially equal to the inside diameter of the core of the paper roll 1 and obviate a play (?) between the flange members 13 and the paper roll 1. Further, three claws 17 alternate with the three ribs 16 on the end of the support portion 15 adjoining the flange portion 14. The claws 17 press the inner wall of the core of the paper roll 1 to thereby lock the flange members 13 to the paper roll 1, as will be described specifically later.

Each support 8 has two rollers 18 rotatably arranged side by side therein. The rollers 18 support associated one of the flange portions 14, so that the paper roll 1 is freely rotatable.

Figure 4:
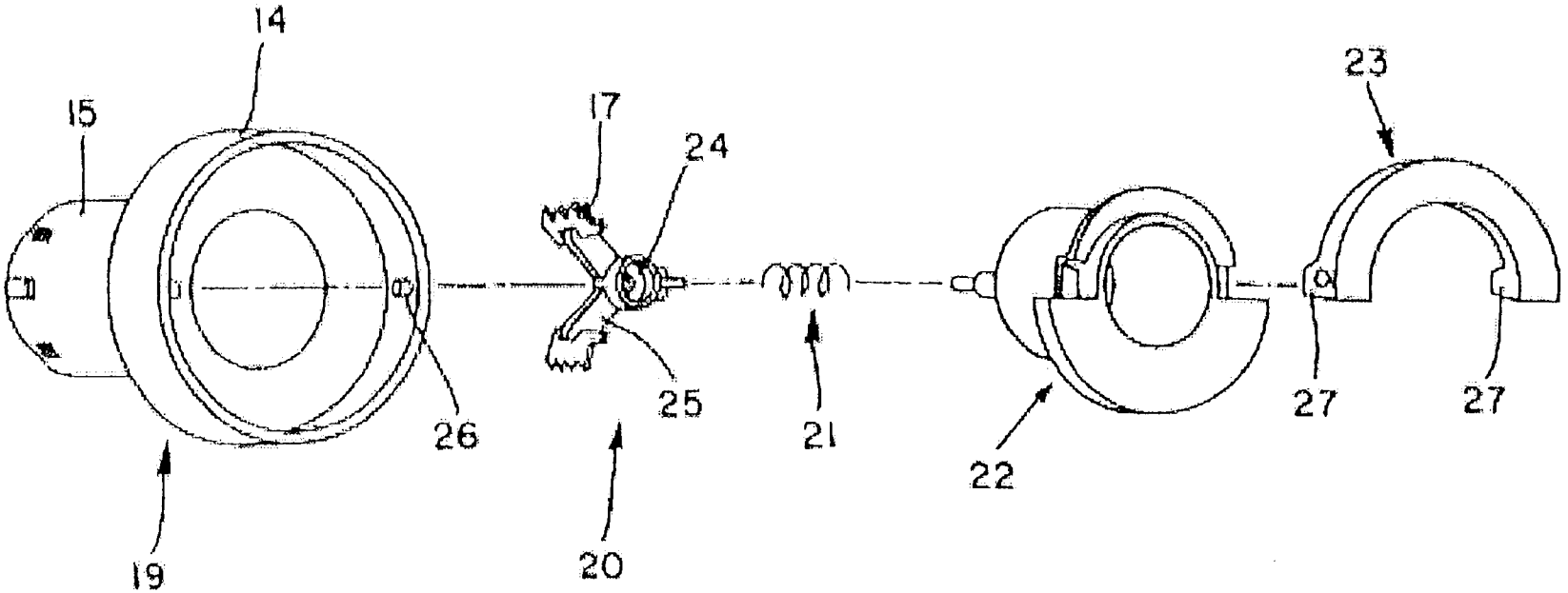
FIG. 4 is an exploded view of a flange member forming part of the paper roll supporting device.

FIG. 4 is an exploded view showing one of the flange members 13 in detail. As shown, the flange member 13 includes a flange body 19 made up of the previously stated flange portion 14 and cylindrical support portion 15. The flange member 13 additionally includes a claw member 20, a spring 21, a presser 22, and a lock/release lever 23. The claw member 20 is received in the flange body 19 and protrudes from the outer circumference of the support portion 15. The spring 21 constantly biases the claw member 20 and has one end seated on the presser 22, so that the presser 22 compresses the spring 21. The lock/release lever 23 is capable of being brought down by hand in order to cause the presser 2 to slide. Lugs or eccentric cams 27 protrude from part of the lock/release lever 23 adjoining the axis of rotation of the lever 23. The claw member 20 has a spring seat 24 on which the other end of the spring 21 is seated, three radially extending arms 25, and the previously mentioned three claws 17 at which the arms 25 terminate, as illustrated. The arms 25 are formed of resin or similar elastically deformable material. The lock/release lever 23 is engaged with bosses 26 formed on the inner circumference of the flange portion 14 and is angularly movable about the bosses 26. When the lock/release lever 23 is brought down about the bosses 26, the lugs 27 push the presser 22 into the flange body 19. The lock/release lever 23 has a length sufficiently greater than the height of the lugs 27, so that the operator can easily bring down the lever 23 in a locking direction.

More specifically, the flange body 19, claw member 20, spring 21, presser 22 and lock/release lever 23 are sequentially arranged in the axial direction in this order, as shown in FIG. 4. When the operator brings down the lock/release lever 23, the lever 23 pushes the presser 22 into the flange body 19. The presser 22, in turn, compresses the spring 21 and thereby presses the claw member 20. Consequently, the arms 25 of the claw member 20 are elastically deformed and force their claws 17 radially outward.

Figure 5:
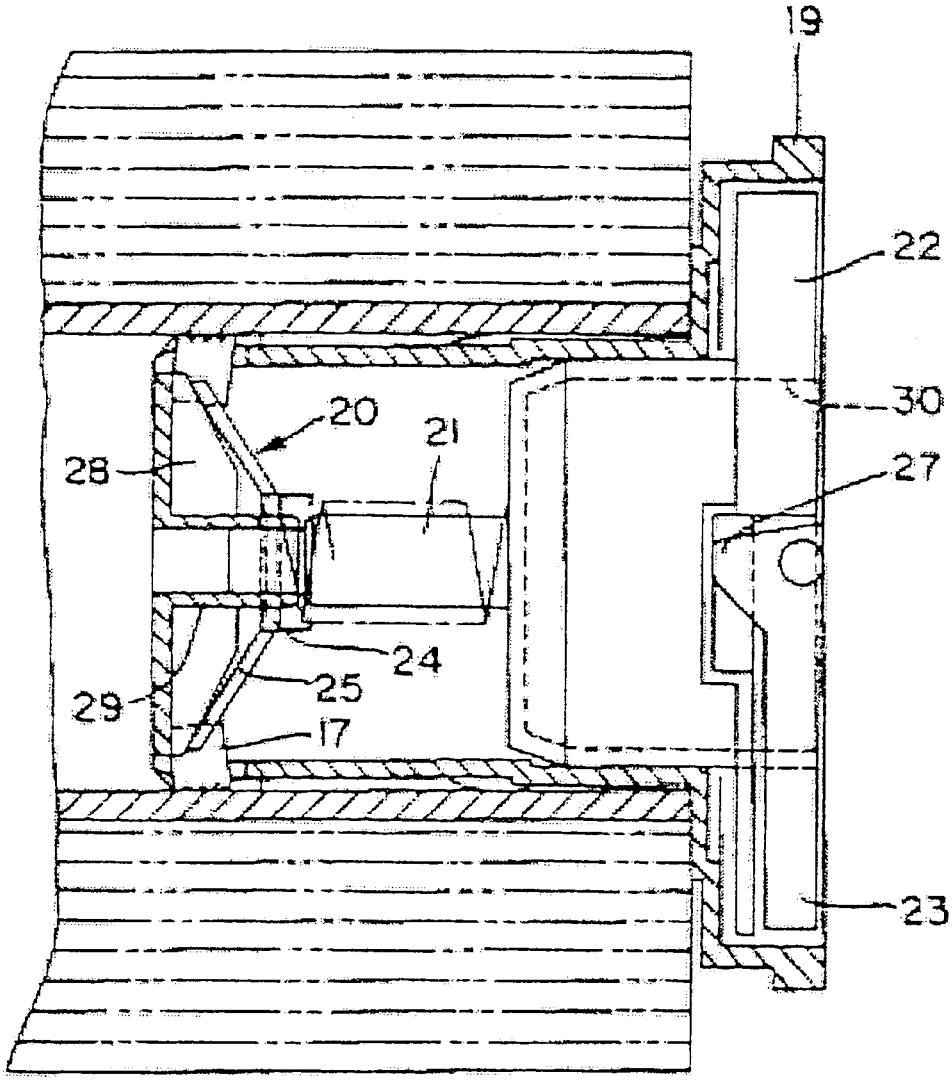
FIG. 5 is a view showing the flange member locked to the paper roll.
Figure 6:
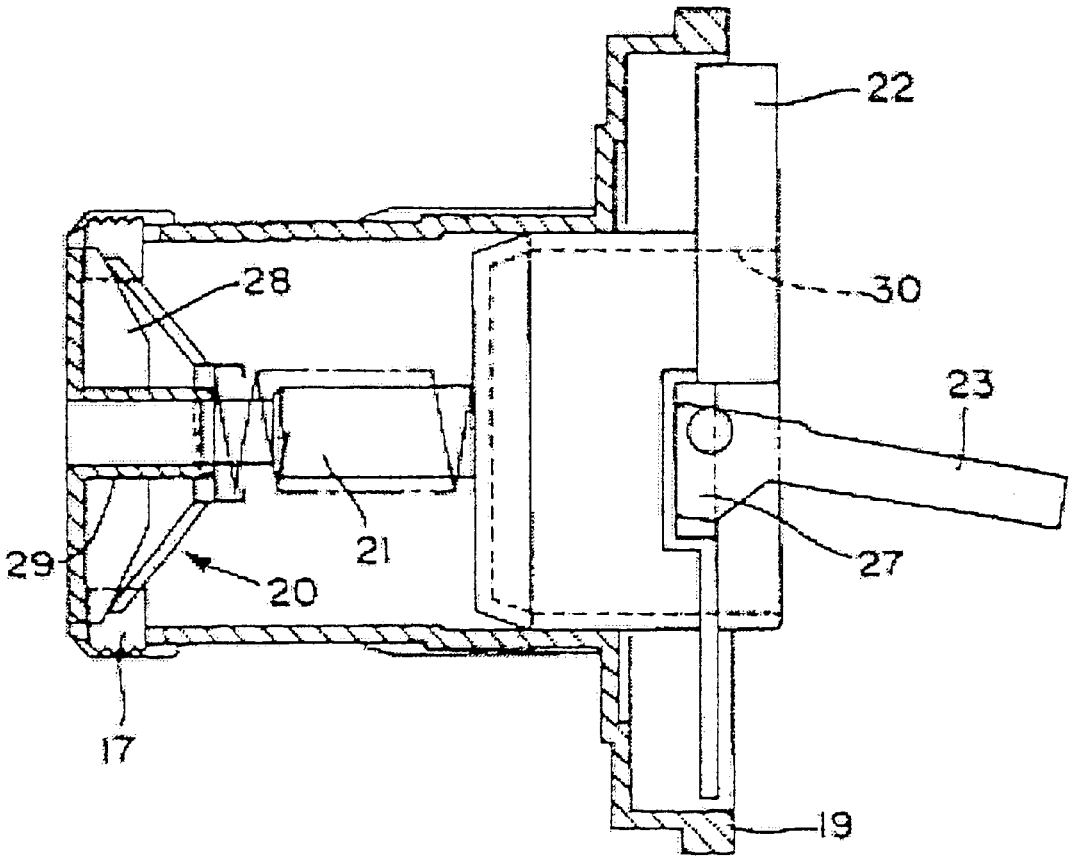
FIG. 6 is a view showing the flange member unlocked from the paper roll.

The movement of the flange member 13 will be described in detail with reference to FIGS. 5 and 6. FIGS. 5 and 6 respectively show the flange member 13 in a locked position and an unlocked or released position. As shown, the flange portion 19 has a tubular configuration whose one end is closed, and has three through holes formed in the end portion remote from the flange 14 and assigned to the three claws 17 of the claw member 20. Such a configuration provides the flange portion 19 with mechanical strength and allows it to firmly support the paper roll 1, which has substantial weight. Three pairs of triangular ribs 28 are formed on the inner wall of the above end of the flange body 19. Each pair of ribs 28 are parallel to each other and assigned to a particular claw 17 for guiding it therebetween. In this sense, each pair of ribs 28 form, when the associated arm 25 deforms, guide surfaces in the flaring direction and the direction of height. Further, a tubular boss shaft 29 extends from the inner wall of the end of the flange body 19. The boss shaft 29 guides the claw member 20 with its outer periphery and guides the presser 22 with its inner periphery. The spring seal 24 of the claw member 20 is formed with a hole corresponding to the boss shaft 29 and plays the role of a guide.

As shown in FIG. 5, to lock each flange member 13 to the paper roll 1, the operator brings down the lock/release lever 23. The lugs 27 of the lock/release lever 23 then push the presser 22 inward and thereby compress the spring 21. The spring 21, in turn, presses the spring seat 24. As a result, the arms 25 elastically deform and cause their claws 17 to protrude radially outward via the holes of the flange body 19, pressing the inner wall of the tubular core of the paper roll 1. Because the claws 17 flare until they abut against and press the inner wall of the core, they surely lock the flange member 13 to the core without regard to the tolerance of the diameter of the core. The side of the presser 22 adjoining the flange 4 is formed with a bore complementary in shape to the outer contour of the presser 22. The bore forms a catch 30 that the operator can use when fitting the flange member 13 into the paper roll 1. Because the catch 30 is cylindrical and has no directionality, it is not dependent on the angular position of the flange member 13.

As shown in FIG. 6, when the flange member 13 is unlocked from the paper roll 1, the lock/release lever 23 is positioned right above the catch 30 due to the shape of the lugs 27. This prevents the operator from touching the catch 30 and thereby prevents the operator from, e.g., forgetting to lock the flange member 13 to the paper roll 1. As shown in FIG. 5, when the flange member 13 is locked to the paper roll 1, the lock/release lever 23 pushes the presser 22 inward to a position where the presser 22 does not protrude from the flange 14, making the end face of the flange member 13 flat.

Such a flat end face allows the operator to surely see the locked position of the flange member 13 and easily handle the flange member 13. It follows that the paper roll 1 with the flange members 13 can be stored in an upright position or in a sack, as desired. This makes it needless for the operator to fit and unfit the flange members 13 every time the operator replaces the paper roll 1, contributing a great deal to easy handling.

Figure 7:
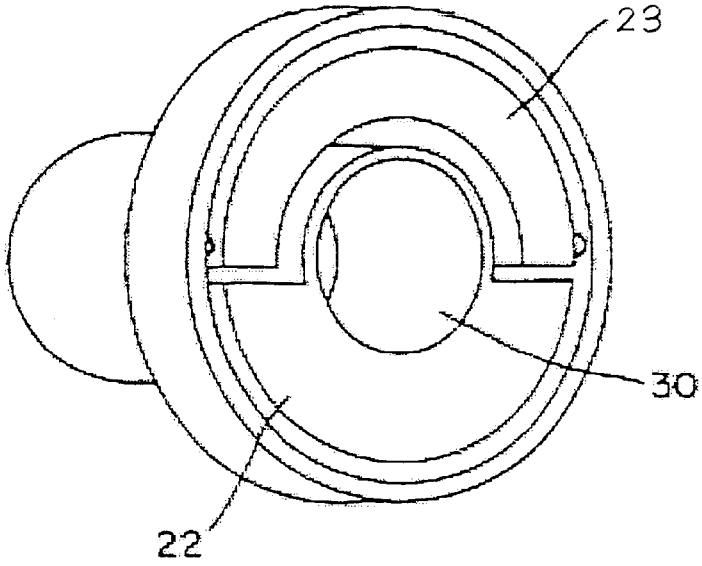
FIG. 7 is an isometric view showing the end face of the flange with a lock/release lever being brought down to a locking position.
Figure 8:
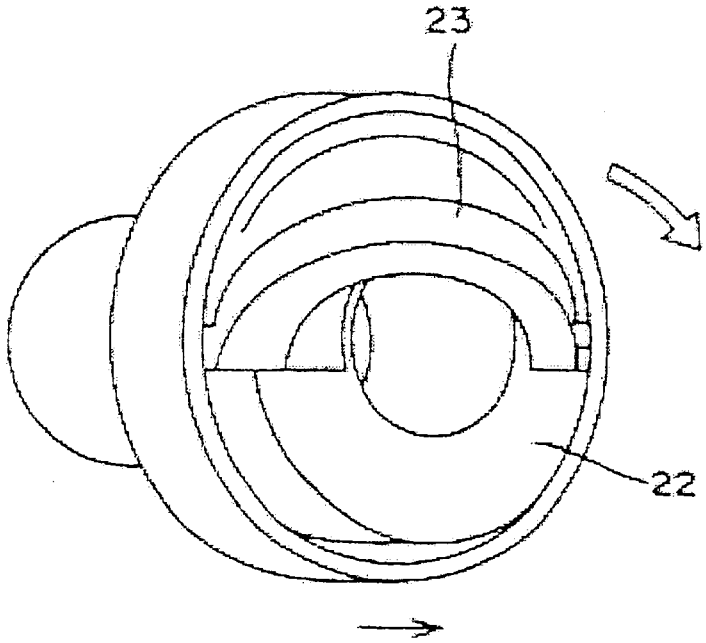
FIG. 8 is an isometric view showing the end face of the flange with the lock/release lever being raised to an unlocking position.

FIGS. 7 and 8 are isometric views showing the flange member 13 in the locked position and unlocked position, respectively. As shown in FIG. 7, in the locked position, the lock/release lever 23 is brought down and makes the flange surface flat while exposing the catch 30 to the outside. As shown in FIG. 8, in the unlocked position, the lock/release lever 23 is raised and obstructs the operator's manipulation.

Figure 9:
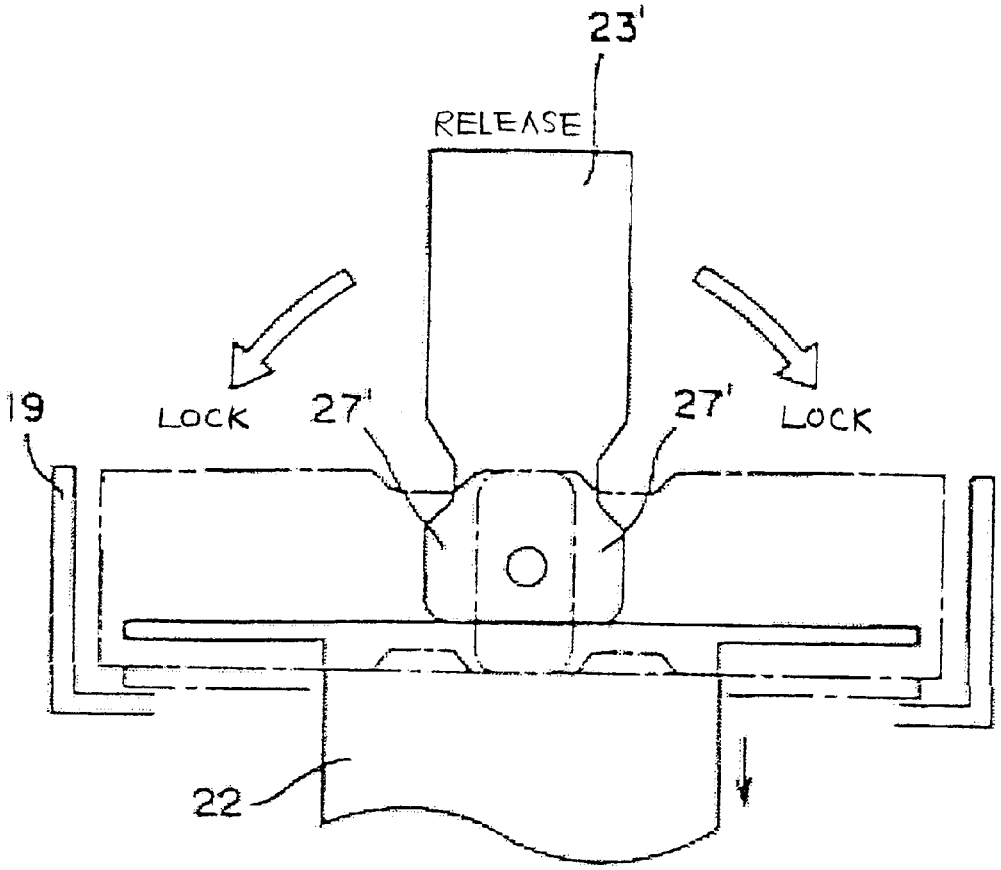
FIG. 9 is a view showing a modified form of the lock/release lever.

FIG. 9 shows a lock/release lever 23' that is a modification of the above-described lock/release lever 23. As shown, the lock/release lever 23' is configured such that it can be brought down to either side about a fulcrum. The lever 23' is symmetrical in the right-and-left direction, as viewed in FIG. 9, so that the operator does not have to care about the direction in which the lever 23' should be brought down. The lever 23' therefore further enhances easy operation, compared to the lever 23. Moreover, while the lever 23 will be broken when forcibly brought down in the direction opposite to the expected direction, the lever 23' is free from such an occurrence because it can be brought down in either direction.

In summary, it will be seen that the present invention provides a paper roll supporting device for an image forming apparatus having various unprecedented advantages, as enumerated below.

(1) The device is far easier to handle than the conventional screw type of device and free from an occurrence that flanges themselves rotate in the event of locking as in, e.g., Laid-Open Publication No. 7-48598 mentioned earlier.

(2) A large paper roll for use in, e.g., a copier is extremely heavy and must be supported by a great force. The device of the present invention transforms the rotation of a lever to a force that pushes pressing means inward, thereby reducing a load. The leverage (force reduction ratio) can be far greater than the conventional rotation type configuration.

(3) The device allows a paper roll to be stored in an upright position or in a sack when brought to a projection-free position. Narrow paper rolls can even be stacked one above the other. It is therefore needless for the operator to fit and unfit the device every time the paper roll is replaced.

(4) The operator does not have to care about the direction in which a lock/release lever should be brought down. The lock/release lever is therefore easier to operate than a lock/release lever that should be brought down only in one direction. Further, the lever, which can be brought down in either side, is free from damage ascribable to operator's forcible action.

(5) The device is easy to handle and promotes easy transport of a paper roll. Because the device uses a space that has customarily been a dead space, it is superior to a grip scheme as to space efficiency.

(6) The device prevents the operator from handling the device without fully locking the device to a paper roll.

Various modifications will become possible for those skilled in the art after receiving the teachings of the present disclosure without departing from the scope thereof.

What is claimed is:

1. In a paper roll supporting device including a pair of cylindrical flange members capable of being respectively fitted into opposite ends of a paper roll, said pair of flange members each comprise:

a flange body comprising a flange portion and a cylindrical support portion that is to be inserted into a tubular core of the paper roll;

a claw member having a plurality of claws capable of protruding from an outer circumference of said support portion;

a biasing member for exerting a pressure on said claw member;

pressing means slidable in a direction in which said biasing member is compressible, said pressing means receiving one end of said biasing member and contacting an inner circumference of said support portion; and a lock/release lever capable of being brought down for causing said pressing means to slide;

said claw member causing said plurality of pawls to flare in a radial direction when pressed in an axial direction of said support portion.

2. A device as claimed in claim 1, wherein said lock/release lever has eccentric cams adjoining a fulcrum about which said lock/release lever is rotatable, said eccentric cams causing said pressing means to slide.

3. A device as claimed in claim 2, wherein when said flange member is inserted into the paper roll, said pressing means and said lock/release lever are received in said flange body to thereby make an end face of said flange body flat.

4. A device as claimed in claim 3, wherein said lock/release lever is capable of being brought down in either direction from a raised unlocking position to a lowered locking position at which said pressing means slides to cause said claws to flare in the radial direction.

5. A device as claimed in claim 4, wherein an end of said support portion adjoining said flange portion is formed with a bore that serves as a catch for an operator when said flange member is fitted into the paper roll.

6. A device as claimed in claim 5, wherein said lock/release lever interferes with said catch in the unlocking position, but does not interfere with said catch in the locking position.

7. A device as claimed in claim 3, wherein an end of said support portion adjoining said flange portion is formed with a bore that serves as a catch for an operator when said flange member is fitted into the paper roll.

8. A device as claimed in claim 7, wherein said lock/release lever interferes with said catch in the unlocking position, but does not interfere with said catch in the locking position.

9. A device as claimed in claim 2, wherein said lock/release lever is capable of being brought down in either direction from a raised unlocking position to a lowered locking position at which said pressing means slides to cause said claws to flare in the radial direction.

10. A device as claimed in claim 9, wherein an end of said support portion adjoining said flange portion is formed with a bore that serves as a catch for an operator when said flange member is fitted into the paper roll.

11. A device as claimed in claim 10, wherein said lock/release lever interferes with said catch in the unlocking position, but does not interfere with said catch in the locking position.

12. A device as claimed in claim 2, wherein an end of said support portion adjoining said flange portion is formed with a bore that serves as a catch for an operator when said flange member is fitted into the paper roll.

13. A device as claimed in claim 12, wherein said lock/release lever interferes with said catch in the unlocking position, but does not interfere with said catch in the locking position.

14. A device as claimed in claim 1, wherein when said flange member is inserted into the paper roll, said pressing means and said lock/release lever are received in said flange body to thereby make an end face of said flange body flat.

15. A device as claimed in claim 14, wherein said lock/release lever is capable of being brought down in either direction from a raised unlocking position to a lowered locking position at which said pressing means slides to cause said claws to flare in the radial direction.

16. A device as claimed in claim 15, wherein an end of said support portion adjoining said flange portion is formed with a bore that serves as a catch for an operator when said flange member is fitted into the paper roll.

17. A device as claimed in claim 16, wherein said lock/release lever interferes with said catch in the unlocking position, but does not interfere with said catch in the locking position.

18. A device as claimed in claim 14, wherein an end of said support portion adjoining said flange portion is formed with a bore that serves as a catch for an operator when said flange member is fitted into the paper roll.

19. A device as claimed in claim 18, wherein said lock/release lever interferes with said catch in the unlocking position, but does not interfere with said catch in the locking position.

20. A device as claimed in claim 1, wherein said lock/release lever is capable of being brought down in either direction from a raised unlocking position to a lowered locking position at which said pressing means slides to cause said claws to flare in the radial direction.

21. A device as claimed in claim 20, wherein an end of said support portion adjoining said flange portion is formed with a bore that serves as a catch for an operator when said flange member is fitted into the paper roll.

22. A device as claimed in claim 21, wherein said lock/release lever interferes with said catch in the unlocking position, but does not interfere with said catch in the locking position.

23. A device as claimed in claim 1, wherein an end of said support portion adjoining said flange portion is formed with a bore that serves as a catch for an operator when said flange member is fitted into the paper roll.

24. A device as claimed in claim 23, wherein said lock/release lever interferes with said catch in the unlocking position, but does not interfere with said catch in the locking position.

* * * * *